US005820937A

United States Patent [19]

Crabtree et al.

[11] Patent Number: 5,820,937

[45] Date of Patent: Oct. 13, 1998

[54] PROCESS FOR MAKING HIGH ABRASION OVERLAYS

[75] Inventors: Richard S. Crabtree, Waverly; Larry O. Hill, Frankfort, both of Ohio

[73] Assignee: The Mead Corporation, Dayton, Ohio

[21] Appl. No.: 568,020

[22] Filed: Dec. 6, 1995

Related U.S. Application Data

[63] Continuation-in-part of Ser. No. 387,249, Feb. 13, 1995, abandoned, which is a continuation-in-part of Ser. No. 898,557, Jun. 15, 1992, abandoned.

[51] Int. Cl.[6] ..... B05D 1/30

[52] U.S. Cl. ..... 427/420; 162/184; 162/186; 118/410; 118/DIG. 4

[58] Field of Search ..... 162/184, 186; 427/420; 118/DIG. 4, 410

[56] References Cited

U.S. PATENT DOCUMENTS

| | | | |
|---|---|---|---|
| Re. 30,233 | 3/1980 | Lane et al. | 428/207 |
| 771,443 | 10/1904 | Perkiewicz . | |
| 3,125,484 | 3/1964 | Weiss | 161/6 |
| 3,135,643 | 6/1964 | Michl | 161/79 |
| 3,373,070 | 3/1968 | Fuerst | 161/79 |
| 3,373,071 | 3/1968 | Fuerst | 161/79 |
| 3,384,536 | 5/1968 | Sandberg et al. | 162/186 |
| 3,433,694 | 3/1969 | Nuttall | 156/244 |
| 3,940,538 | 2/1976 | Palazzolo et al. | 428/318 |
| 3,973,961 | 8/1976 | Stroszynski | 96/1.5 |
| 4,008,121 | 2/1977 | Coleman | 162/124 |
| 4,076,566 | 2/1978 | Power | 156/153 |
| 4,249,478 | 2/1981 | Gruener | 118/668 |
| 4,255,480 | 3/1981 | Scher et al. | 428/208 |
| 4,305,987 | 12/1981 | Scher et al. | 428/148 |
| 4,322,468 | 3/1982 | Raghava | 428/204 |
| 4,327,141 | 4/1982 | Scher et al. | 428/148 |
| 4,460,655 | 7/1984 | Jacobson | 428/530 |
| 4,505,974 | 3/1985 | Hosler | 428/329 |
| 4,567,087 | 1/1986 | O'Dell et al. | 428/211 |
| 4,689,102 | 8/1987 | Prawdzik et al. | 156/235 |
| 4,713,138 | 12/1987 | Ungar et al. | 156/307.4 |
| 4,816,314 | 3/1989 | Prawdzik et al. | 156/235 |
| 4,880,689 | 11/1989 | Park et al. | 428/143 |
| 4,971,855 | 11/1990 | Lex et al. | 428/206 |

FOREIGN PATENT DOCUMENTS 987217 4/1976 Canada .

*Primary Examiner*—Katherine A. Bareford
*Attorney, Agent, or Firm*—Thompson Hine & Flory LLP

[57] ABSTRACT

A process for forming an abrasion resistant sheet which comprises forming a web of cellulosic fibers on a papermaking machine and applying a slurry including an abrasion-resistant grit to the upper surface of the web on the papermaking machine using a slot orifice coating head applicator, said grit being uniformly distributed on said surface of said fibrous cellulosic overlay sheet at a coat weight of about 2 to 40 pounds per 3000 square feet.

17 Claims, 3 Drawing Sheets

PROCESS FOR MAKING HIGH ABRASION OVERLAYS

CROSS-REFERENCE TO RELATED APPLICATIONS

This is a continuation-in-part of U.S. application Ser. No. 08/387,249 filed Feb. 13, 1995, now abandoned which in turn is a continuation-in-part of U.S. application Ser. No. 07/898,557 filed Jun. 15, 1992, now abandoned.

FIELD OF THE INVENTION

The present invention relates to a process for making high abrasion overlays with grit. This high abrasion overlay provides a high degree of abrasion resistance, suitable for use in high and low pressure laminates for the production of counter tops, wall panels, floor surfacing, and the like.

BACKGROUND OF THE INVENTION

Decorative laminates are conventionally manufactured by assembling several layers of a sheet material such as paper or fabric impregnated with resins of various kinds. Typically, the resins may be selected from phenolics, aminoplasts, polyesters, polyurethanes, epoxy resins, melamine resins and the like.

The selection of the paper or fabric to be used, and the resin for impregnation is governed by the intended end-use of the finished laminate. For some end uses, surface decoration is not required, but in many instances colors and/or patterns are desired to add eye appeal to the finished laminate. While color and/or pattern decoration may be desired for an outer surface of the laminate, the core or base functions primarily as a strengthening support, and may comprise wood, such as plywood, multiple layers of unbleached or dark colored paper or cloth, and may utilize dark colored, less expensive impregnating resins, such as phenolic resins.

When a decorated or printed surface is desired in the laminate, an outer surface layer known as a decor sheet is used to cover the core layer or layers. The decor sheet is a colored decorative paper which may be pigmented with titanium dioxide and/or other opacifying pigments or printed decorative paper, where decorative paper is further printed with patterns to mask the dark-colored core stock. The decor layer may be impregnated with a wide variety of resins such as melamine resins, polyester resin, etc.

It is desired to protect the surface of a decorative laminate. Otherwise, continuous use will damage the printed pattern. To impart wear and/or abrasion resistance to decorated laminates, it has long been the practice to place a resin-impregnated surfacing paper known as an overlay over the decor sheet. Upon consolidating the laminate, the overlay sheet becomes transparent, permitting the printed pattern on the decor sheet to be seen therethrough. More recently, grit particles such as aluminum oxide have been incorporated into overlay papers to give added abrasion resistance to the laminates incorporating them. Likewise, printed decor papers have been coated with resin syrups containing abrasion resisting particles. The use of decorative laminates including high abrasion overlays as a flooring material is gaining popularity especially in Europe.

Currently, a layer of grit is applied to the surface of decor sheet using a secondary headbox application on the papermaking machine. This method of applying the grit to the overlay sheet is plagued by extreme variations in the distribution and coverage of grit across the web and loss of grit in the Z direction of the sheet.

SUMMARY OF THE INVENTION

The present invention relates to a method for applying a grit to a fibrous cellulosic overlay sheet in which the layer of grit is evenly distributed across the surface of the sheet using a slot orifice coating head applicator on the wet end of paper machine. The use of a slot orifice coater (as contrasted with a secondary head box) increases the efficiency and uniformity of the grit application and reduces waste.

The slot orifice coating head applicator is employed directly on the papermaking machine in accordance with the invention. The applicator may be positioned anywhere after the primary headbox and before the dryers, but it is preferably located near and, more preferably, immediately after the dry line, i.e., the point at which the deposited fibers begin to exhibit consolidation and there is no layer of surface water. The slot orifice coating head applicator is used in conjunction with a positive displacement pump which enables a predetermined amount of the grit composition to be evenly distributed across the surface of the cellulosic sheet. A static mixer may be incorporated in the slot orifice coater supply line to prevent or reduce the amount of grit settling out of the slurry.

DETAILED DESCRIPTION OF THE INVENTION

In accordance with the present invention, a uniform layer of grit is applied to the surface of a fibrous cellulosic overlay sheet from a grit-containing slurry using a slot orifice coating head applicator. The term "slot orifice coater" as used herein is used in the same manner it is used in the art, namely, to designate a coater having a central cavity which opens on and feeds a slot through which the coating is forced under pressure. Examples of slot orifice coaters useful in the present invention include curtain coaters in which the overlay is coated as it passes through a falling curtain of the coating composition and coaters in which the overlay is coated as it contacts a bead of the coating composition as it is extruded from a slot orifice. The latter type coaters can be oriented to coat the substrate as it passes directly above the coater, directly below the coater or to the side of the coater. The slot width of the slot orifice coaters used in the process typically range from 0.4 to 0.8 mm. The gap height (i.e., the distance between the edge of the slot orifice and the substrate surface) is about 0.5 to 1.55 mm when coating form a bead and about 2.5 to 25 mm when coating form a curtain. The coating head pressure is about 5 to 25 psig when coating form a bead and about 5 to 150 psig when coating from a curtain. A slot orifice coater useful in the present invention is sold by Liberty Tool Corp. under the tradename Technikote. Other manufacturers also make slot orifice coaters useful herein. The sheet may be a decor sheet or an overlay sheet.

Figure 1:
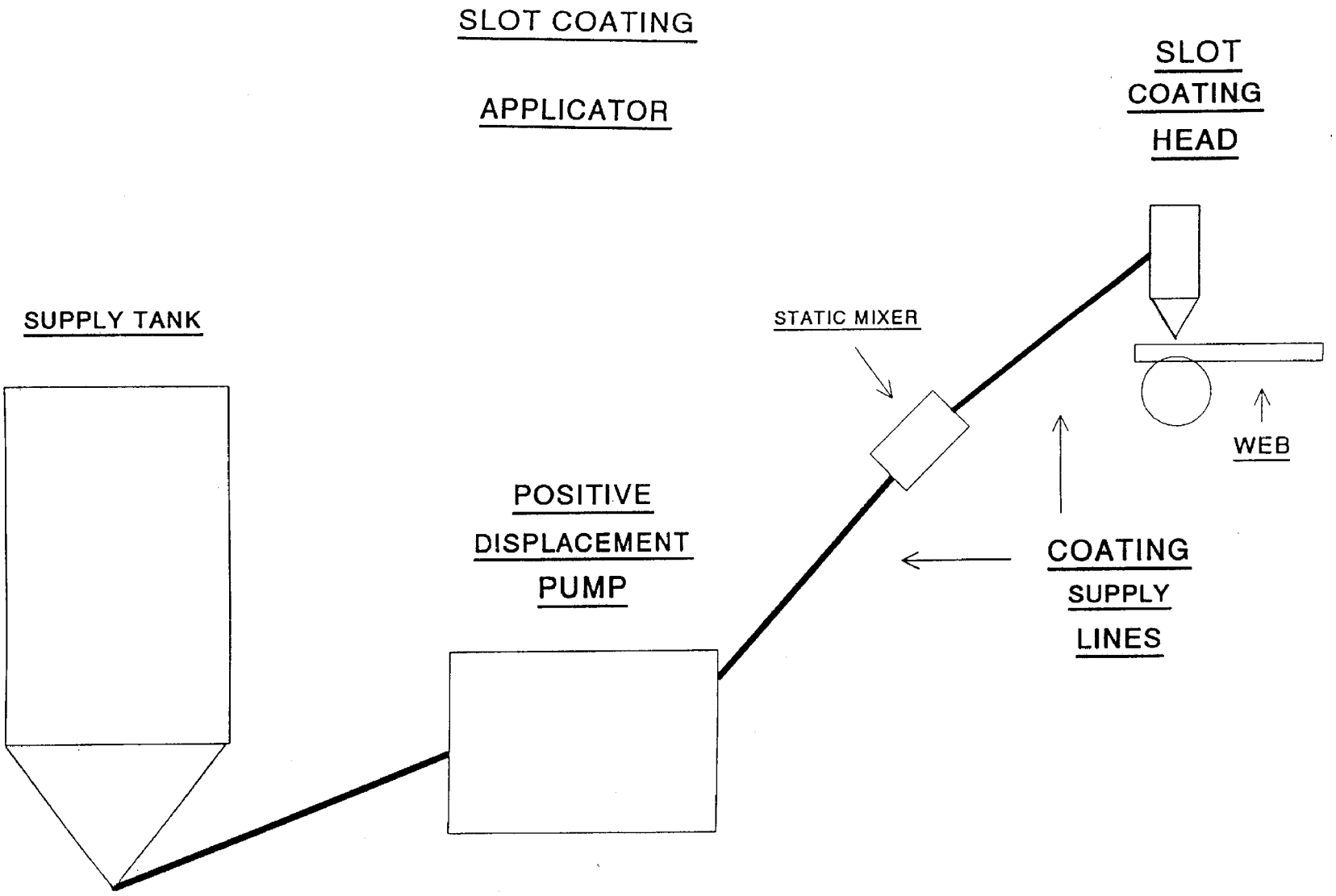
FIG. 1 is a diagram of the coating method in accordance with the invention.

As illustrated in FIG. 1, an aqueous slurry of aluminum oxide grit stored in a supply tank is transferred through a coating supply line to a positive displacement pump which pumps a predetermined amount of the slurry to the slot orifice coating head. An agitating means such as a static mixer may be positioned between the pump and the slot orifice coating head to prevent the grit from settling out of the slurry. The grit-containing slurry is then applied to the raw fibrous cellulosic web using the slot orifice coater which distributes the grit-containing slurry evenly across the surface of the web. Preferably the slot orifice coater is a curtain coater. The coated web is then dried by any conventional means to provide a fibrous cellulosic sheet such as a decor sheet or overlay sheet having a layer of abrasion-resistant grit particles on the surface of the sheet.

Figure 2:
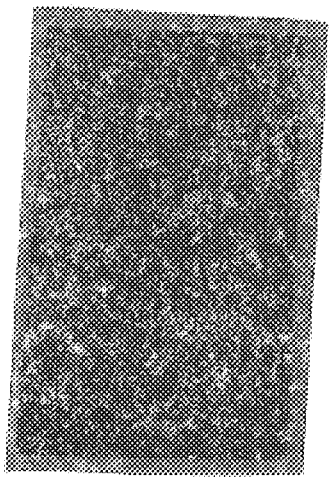
FIG. 2 is an electron microscope photograph of the surface of an overlay coated with 29.1 pounds per 3,000 square feed of grit using a slot orifice curtain coater in accordance with the present invention.
Figure 3:
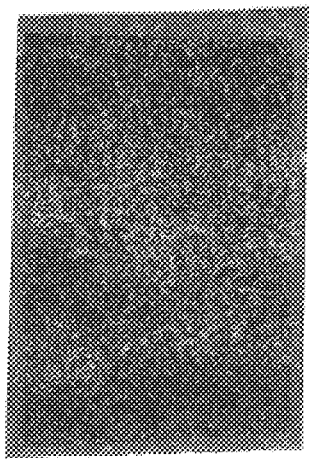
FIG. 3 is an electron microscope photograph of the surface of an overlay coated with 28 pounds per 3,000 square feet of a grit using a secondary headbox in accordance with the prior art.

A particular advantage of the present invention is that the slot orifice coating head applicator enables the delivery of a predetermined amount of the slurry mixture to be applied in an evenly distributed manner to the surface of the overlay sheet at a coat weight of about 2 to 40 pounds per 3000 square feet (dry basis). The use of the slot orifice coating head applicator not only increases the efficiency of the operation by evenly distributing the grit slurry mixture across the decor sheet but it reduces the cost of the process significantly by reducing waste while still achieving required or desirable product standards. FIG. 2 and FIG. 3 are photographs which compare the coating achieved with a slot orifice curtain coater in accordance with the invention and a secondary headbox in accordance with the prior art. FIG. 2 shows that the coating applied using the slot orifice curtain coater is more even and uniform as compared to the coating shown in FIG. 3, which is very streaky and non-uniform and has a slight mottled appearance, which was prepared using a secondary headbox application system.

The use of the slot orifice coating head applicator also enables the introduction of other materials and additives which are typically employed in such overlays to be incorporated directly into the grit slurry. For example, the incorporation of melamine resin in the grit mixture is possible and would allow the application of both resin and grit to the fibrous cellulosic sheet in a single step. The line speeds which can be used will vary with the nature of the coating composition and the specific type of slot orifice coater used. Line speeds of about 1 to 100 fpm can be used when the coating is applied from a bead whereas line speeds of about 500 to 4000 fpm can be used when the coating is applied from a curtain.

The slot orifice coater can be used to apply slurries containing about 5% to 95% by weight and, more particularly, about 10% to 80% by weight solids. By comparison, a secondary headbox is generally not useful in applying slurries containing more than about 0.5 to 5% and more particularly about 1% or 2% solids. As a result of the higher slurry concentrations that can be applied in the present invention, higher line speeds and/or lower coating flow rates can be used than are feasible with application of the slurry from a secondary headbox. In particular, using the headbox, it is not unusual when coating a web 10 feet wide to apply the coating at a flow rate of 500–1000 gallons per minute. At these rates, water from the coating slurry cascades through the sheet and carries significant quantities of unretained grit with it. With the slot orifice coaters, on the other hand, flow rates on the order of 5 to 10 gallons per minute are commonly used when coating a web 10 feet wide from a bead and 5 to 50 gallons per minute when coating from a curtain and the quantities of water and unretained grit are substantially less.

The grit employed in the present invention can be a mineral particle such as silica, alumina, alundun, corundum, emery, spinel, as well as other materials such as tungsten carbide, zirconium boride, titanium nitride, tantalum carbide, beryllium carbide, silicon carbide, aluminum boride, boron carbide, diamond dust, and mixtures thereof. The suitability of the particular grit will depend on several factors such as availability, cost, particle size distribution and even the color of the particles.

Considering cost availability, hardness, particle size availability and lack of color, aluminum oxide is the preferred grit for most applications. End use performance dictates the basis weight, ash loading, size and type of grit particles. The grit preferably has an average particle size of about 10 to 100 microns and a particle size distribution of about 10 to 150 microns.

The grit slurry employed in the present invention typically includes a binder material. The binder material may be any of the commonly used binders such as melamine resins, polyvinyl alcohol, acrylic latex, starch, casein, styrene-butadiene latex, carboxymethyl cellulose (CMC), microcrystalline cellulose, sodium alginate, etc., or mixtures thereof which are used in coating compositions where the coating material is to be bonded to a substrate such as a decor sheet or overlay sheet. Melamine resins such as melamine-formaldehyde are advantageously used as the binder material in the present invention since the melamine-formaldehyde resin is also commonly used to saturate the decor sheet. The binder is usually employed in an amount of about 1 to 10% by weight of coating solids. When coating form a head box no binder is usually used.

The slurry medium can contain about 5 to 95% and, preferably, about 10 to 80% grit. Preferably the slurry has a viscosity of about 50 to 150 cps when coating from a bead and about 50 to 500 cps when coating form a curtain. For curtain coating, the slurry preferably includes a small amount of a surfactant (0.05 to 0.5%).

The overlay sheet is formed from fibers conventionally used for such purpose and, preferably, is a bleached kraft pulp. The pulp may consist of hardwoods or softwoods or a mixture of hardwoods and softwoods which is normally preferred. Higher alpha cellulose such as cotton may be added to enhance certain characteristics such as post-formability. The basis weight of the uncoated overlay sheet may range from about 10 to 40 pounds per 3000 square feet, and preferably about 15 to 40 pounds per 3000 square feet.

Abrasion values of 1,500 to 20,000 cycles (NEMA: LD3.13) can be achieved by selecting the grit and the base stock and adjusting coating conditions within the aforesaid parameters.

The invention will be illustrated in more detail by the following nonlimiting example.

EXAMPLE

A slurry was prepared by mixing 24 pounds aluminum oxide having an average particle size of 50 microns with 73 lbs. water in a high shear mixer for fifteen minutes. The slurry was pumped to a Liberty Tool slot orifice coating head under a pressure of 20 psi and applied to a layer of pulp one foot wide which had been deposited on the paper machine wire. The slurry was dispensed from the coating head at a flow rate of 0.73 gallons per minute and a line speed of 67.5 lineal feet per min. The coating was applied in a dry coat weight of about 10 pounds per 3000 sq.ft.

Having described the invention in detail, it will be apparent that modifications and variations are possible without departing from the scope of the invention defined in the appended claims:

What is claimed is:

1. A process for forming an abrasion resistant overlay sheet which comprises forming a web of cellulosic fibers on a wet end of a papermaking machine, said web having an upper surface and a basis weight of about 10 to 40 pounds per 3000 square feet and applying a slurry including a binder and an aluminum oxide grit to the upper surface of the web on the wet end of a papermaking machine using a slot orifice coating head, said grit being uniformly distributed on said surface of said web at a coat weight of about 2 to 40 pounds per 3000 square feet.

2. The process of claim 1 where the papermaking machine includes a primary headbox and dryers and the slot orifice coating head is located after the primary headbox and before the dryers.

3. The process of claim 2 wherein the web includes a dry line and the slot orifice coating head is located immediately after the dry line.

4. The process of claim 1 wherein said slurry is applied to the surface of said web from a slot orifice curtain coater.

5. The process of claim 1 wherein said slurry is applied to the surface of said web by contacting said surface with a bead of said slurry formed by the slot orifice coater.

6. The process of claim 1 wherein said slurry is an aqueous-based slurry having a viscosity of about 50 to 500 cps.

7. The process of claim 1 wherein said slurry is applied to said surface of said web using a positive displacement pump in conjunction with said slot orifice coating head applicator.

8. The process of claim 1 wherein said slot orifice coating head is supplied with said slurry through supply lines and at least one static mixer is incorporated into the supply lines of said slot orifice coating head applicator to prevent said grit from settling from said slurry.

9. The process of claim 1 wherein said cellulosic fibers include hardwood and softwood fibers.

10. The process of claim 1 wherein said slurry further includes a binder material.

11. The process of claim 1 wherein said slurry is applied to said substrate at a rate of about 5 to 50 gallons per minute per ten feet width of substrate.

12. The process of claim 11 wherein said substrate travels at a line speed of about 100 to 4000 fpm as it is coated with said slurry.

13. The process of claim 1 wherein said web has a dry basis weight of about 10 to 40 pounds per 3000 square feet.

14. The process of claim 13 wherein said web has a dry basis weight of about 15 to 40 pounds per 3000 square feet.

15. The process of claim 1 wherein the slurry contains at least 5% solids by weight.

16. The process of claim 15 wherein the slurry contains at least 10% solids by weight.

17. The process of claim 1 wherein the process yields an overlay which withstands 1,500 to 20,000 abrasion cycles as determined by National Electric Materials Association (NEMA) standard LD3.13.

* * * * *